US005289806A

United States Patent [19]

Hurr

[11] Patent Number: 5,289,806

[45] Date of Patent: Mar. 1, 1994

[54] COMBUSTION ENGINE WITH AT LEAST ONE CAMSHAFT WHICH CAN BE SHIFTED AXIALLY

[75] Inventor: William J. Hurr, Graz, Austria

[73] Assignee: Avl Gesellschaft fur Verbrennungskraftmaschinen und Messtechnik mbH. Prof. Dr. Dr. h.c. Hans List, Graz, Austria

[21] Appl. No.: 88,551

[22] Filed: Jul. 9, 1993

[30] Foreign Application Priority Data

Jul. 13, 1992 [AU] Australia ..... 1437/92

[51] Int. Cl.[5] ..... F01L 1/34

[52] U.S. Cl. ..... 123/90.17; 123/90.18; 74/568 R

[58] Field of Search ..... 123/90.15, 90.16, 90.17, 123/90.18, 90.31; 74/567, 568 R

[56] References Cited

U.S. PATENT DOCUMENTS 3,112,739 12/1963 Peras ..... 123/90.16
3,730,150 5/1973 Codner, Jr. ..... 123/90.18
4,352,344 10/1982 Aoyama et al. ..... 123/90.18
4,516,542 5/1985 Aoyama et al. ..... 123/90.16
4,570,581 2/1986 Titolo ..... 123/90.17
4,643,141 2/1987 Bledsoe ..... 123/90.16
4,753,198 6/1988 Heath ..... 123/90.18

FOREIGN PATENT DOCUMENTS 3503740 8/1986 Fed. Rep. of Germany .

*Primary Examiner*—E. Rollins Cross
*Assistant Examiner*—Weilun Lo
*Attorney, Agent, or Firm*—Watson, Cole, Grindle & Watson

[57] ABSTRACT

To permit axial shifting of a camshaft dependent on its angle of rotation, a shifting device is used which includes a shifting profile made up of two guide grooves which are configured as oppositely oriented helixes and end in ring-shaped idling grooves, and further includes an engaging element which may be introduced into the guide grooves by an activating element.

10 Claims, 7 Drawing Sheets

Fig. 5
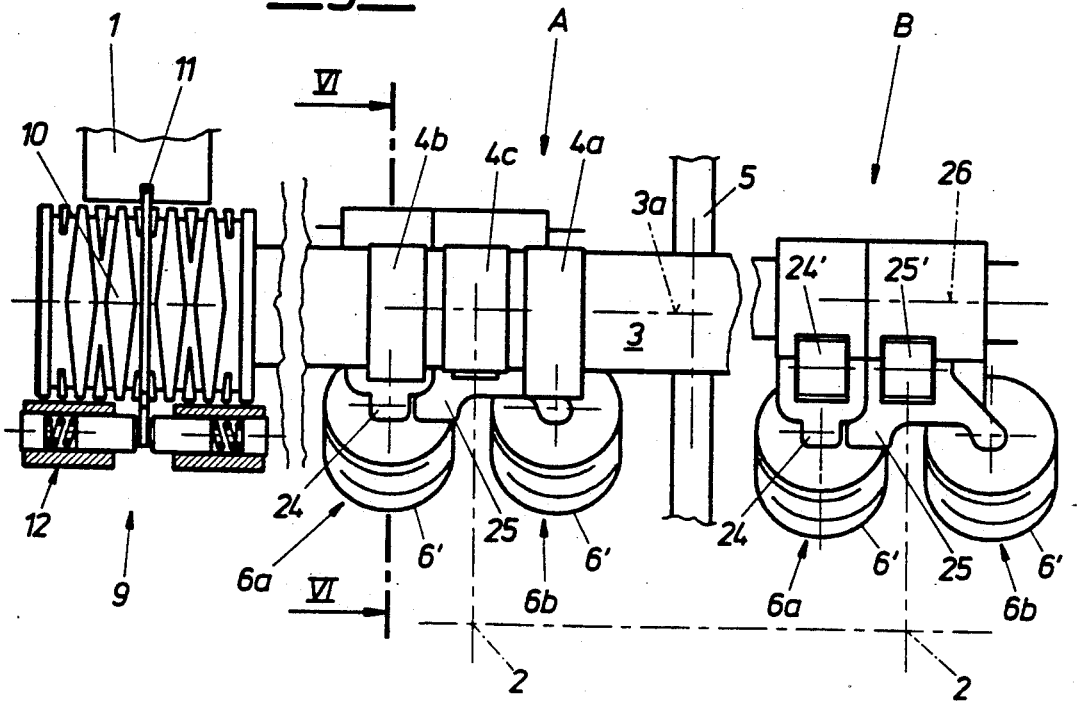
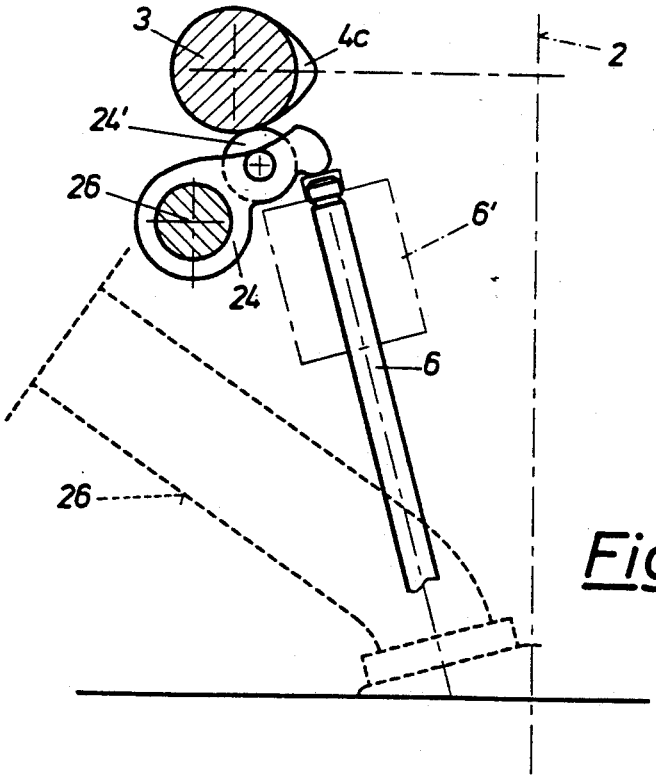
Fig. 6

COMBUSTION ENGINE WITH AT LEAST ONE CAMSHAFT WHICH CAN BE SHIFTED AXIALLY

BACKGROUND OF THE INVENTION

The invention relates to an internal combustion engine with at least one camshaft which can be shifted axially by means of a shifting device and has several switchable cams for each valve, with different axial positions relative to each other.

For variation of the valve lift curve during engine operation in order to ensure optimum valve opening and closing times for each particular operating state of the engine, it is desirable to switch between several cam types per valve during operation. This may be achieved with the use of an axially shiftable camshaft with different cams for each valve.

DESCRIPTION OF THE PRIOR ART

In German laid-open print DE-OS 35 03 740 an internal combustion engine of the above type is described in which the camshaft is shifted in axial direction by means of a hydraulic shifting device. The cams for operation of a valve have identical cam flanks for valve opening. The different control times required for different speeds are obtained by relative rotation of the camshaft by means of the helical gearing of the camshaft wheel. Switching between two cams is made possible by the flanks of two adjacent cams belonging to one and the same valve forming a joint surface. The axial movement is prevented from being locked during shifting between the cams, i.e. by staggering the side faces of the individual cams by a certain amount, following the sequence of valve activation. The switch is triggered by a mechanical or electrical speed pulse, which is independent of the respective camshaft angle. Since there is no relationship between camshaft shift and camshaft angle, however, the valve tappets or transmission levers will strike the side faces of the actuated cams at the beginning of the shifting process, before the tappets or levers arrive at the transition surface between the cams at the base circle or the cam flanks and shifting can take place. This will cause additional noise and increasing wear of the valve mechanism, and can also lead to damage by jamming.

SUMMARY OF THE INVENTION

It is an object of the invention to avoid these disadvantages and to provide a shifting device for camshafts, which will permit controlled and impact-free axial shifting of the camshaft.

In the invention this is achieved by providing that the shifting device comprise a shifting profile consisting of two or more guide grooves which are configured as oppositely oriented helixes and end in ring-shaped idling grooves, and that it further comprise an engaging element which may be introduced into the guide grooves by means of an activating element, the engaging element running in one of the idling grooves defining different operating positions of the camshaft. The slope and position of the helical guide grooves and the position of the individual cams on the camshaft are chosen such that each switchover is effected between two cams of a valve while the mushroom tappet or transmission lever faces a joint tangential plane of the two cams. In this manner no shear stress is exerted on the side faces of the cams. During switchover the camshaft will automatically shift in axial direction from first to second operating position due to the interplay of the engaging element and the guide grooves, the two operating positions being defined by ring-shaped idling grooves. As no additional force is required for shifting the camshaft in this way, the activating element, which is only needed for bringing the engaging element into an initial position, may be kept comparatively small.

A preferred version provides that the two guide grooves, which are configured as oppositely oriented helixes, be cut into the camshaft, and that the engaging element be secured against rotation about the axis of the camshaft and be connected with the cylinder head, preferably by means of a housing of the shifting device. This arrangement will save space and is characterized by design simplicity and low manufacturing cost. It would also be possible, however, to fix the engaging element in the camshaft and to provide the shifting profile in the cylinder head.

In a preferred variant of the invention the proposal is put forward that the engaging element be configured as an open spring ring placed concentrically around the camshaft, which is prevented from rotating together with the camshaft and is attached to the cylinder head or the housing of the shifting device at a point preferably diametrically opposite of the free ends of the spring ring, so as to be secured against axial shifting, where one of the two free ends may be bent by the activating element parallel to the axis of the camshaft. At the beginning of each switching operation one end of the spring ring is bent into an initial position by the activating element, so that the spring ring is introduced into the guide groove moving relative to the spring ring.

In a variant characterized by low friction losses the engaging element is formed by a first and second cylindrical pin instead of a spring ring, the geometrical longitudinal axes of the two pins being approximately normal to the camshaft axis, both pins being held in the cylinder head or in a housing of the shifting device, preferably so as to be rotatable, the second pin also being capable of sliding parallel to the axis of the camshaft, and the sliding motion being effected by the activating element.

It is provided by the invention that the activating element be operated hydraulically. The hydraulic activating element itself may have very small dimensions, since the axial sliding forces are imparted to the camshaft by the camshaft drive.

In a variant of the invention with several valves of one and the same type for each cylinder, the cams used in different operating positions of the camshaft are designed for different valve lift curves. As a consequence optimal valve lifts and control times may be used that are specifically adapted to different operating states of the engine.

In an enhanced variant of the invention it is proposed that the cams used with valves of the same type for each cylinder, which are activated in at least one operating position of the camshaft, be designed for different valve lift curves. This is of special advantage under conditions of partial load, for instance, if one of two intake valves per cylinder obeys a valve lift curve with small lift and short opening time, while the other intake valve is characterized by an even smaller lift and opening time. It would also be possible that the second intake valve remain closed in the part-load range, which would save the opening force required for counteracting the force of the spring and friction.

It is provided in a preferred variant that in at least one operating position of the camshaft one activated cam operate several valves, preferably by means of a forked rocker lever. This will reduce the number of cams on a camshaft, and thus component size and manufacturing cost.

In an internal combustion engine of the invention the method of changing the valve lift provides that for operation of valves (6a, 6b) of one and the same type per cylinder (A, B, C, D)

(a) at full load and high speed one or several cams (4a) be activated which are designed for a valve lift curve with large lift and long opening time, (b) at full load and low speed one or several cams (4b) be activated which are designed for a valve lift curve with short opening time, (c) at partial load at least two cams (4b, 4c) be activated which are designed for different valve lift curves with small lift and short opening time, the camshaft (3) being adjusted in accordance with the operating state of the engine. In this way the valve lift curve is specifically adapted to the respective engine load.

BRIEF DESCRIPTION OF THE DRAWINGS

The invention will be further described by way of example only with reference to the accompanying drawings, in which.

Components with identical functions carry identical reference numbers.

DETAILED DESCRIPTION OF PREFERRED EMBODIMENTS

Figure 1:
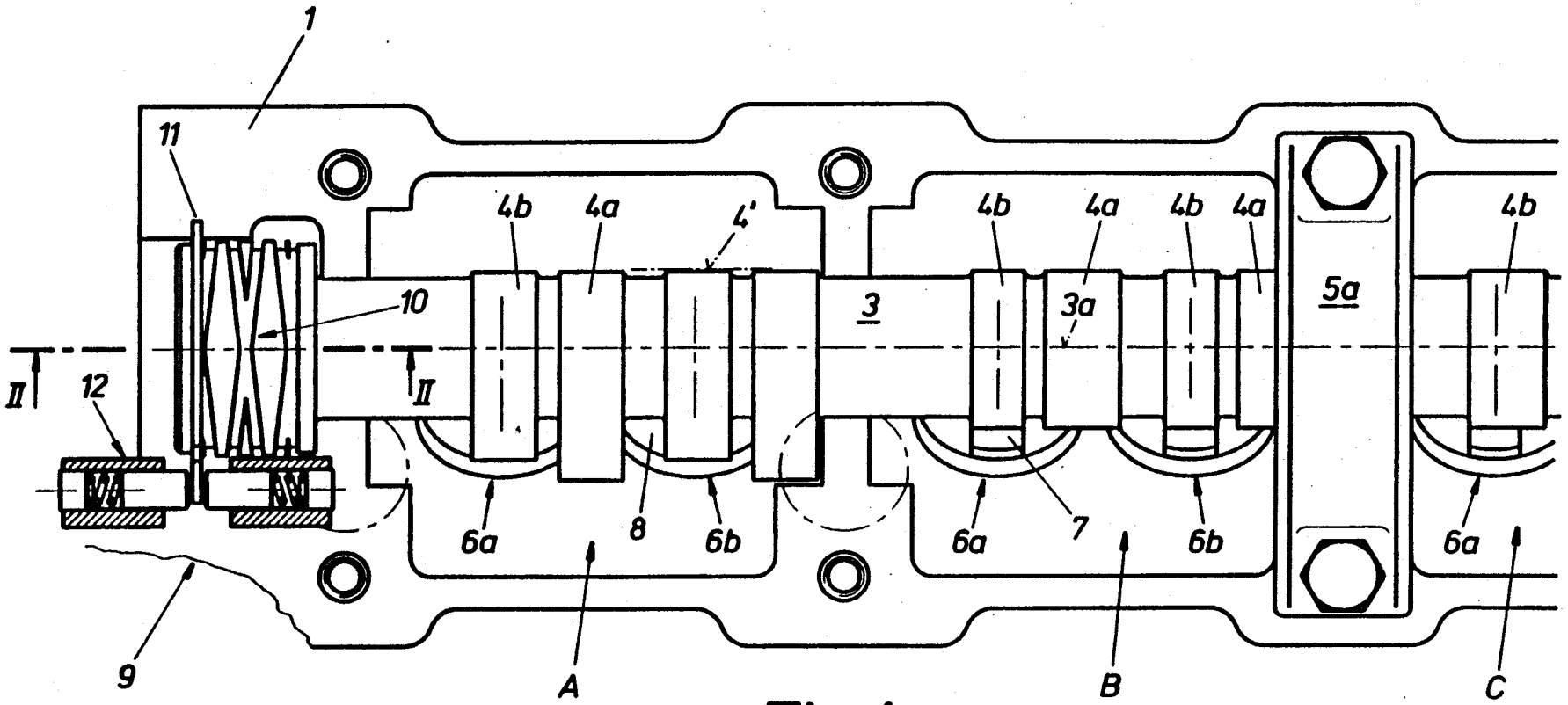
FIG. 1 is a longitudinal view of a camshaft with a shifting device according to the invention.

The examples refer to an internal combustion engine with four cylinders arranged in line. FIG. 1 shows part of a cylinder head 1 of this engine, the bearing brackets 5a of the camshaft having been removed partly. The camshaft 3 has two cams 4a, 4b for each valve 6a, 6b. Cams 4a are designed for a valve lift curve characterized by a large lift and long opening period of valves 6a, 6b for use at full load and high speed, whereas cams 4b are intended for small lifts and short opening periods of valves 6a, 6b at partial load and/or low speed. In the camshaft position shown here cams 4b are active, actuating the valves 6a, 6b via bulges 7 on the mushroom tappets 8. Due to the free flanks of these bulges 7 the adjacent non-active cams 4a are provided with the clearance necessary for free rotation. The mushroom tappets 8 themselves are secured against rotating about the valve axis.

At one end of the camshaft 3 the shifting device 9 is provided, which comprises the shifting profile 10 configured as part of the camshaft 3, and the engaging element 11 and the activating element 12.

Figure 2:
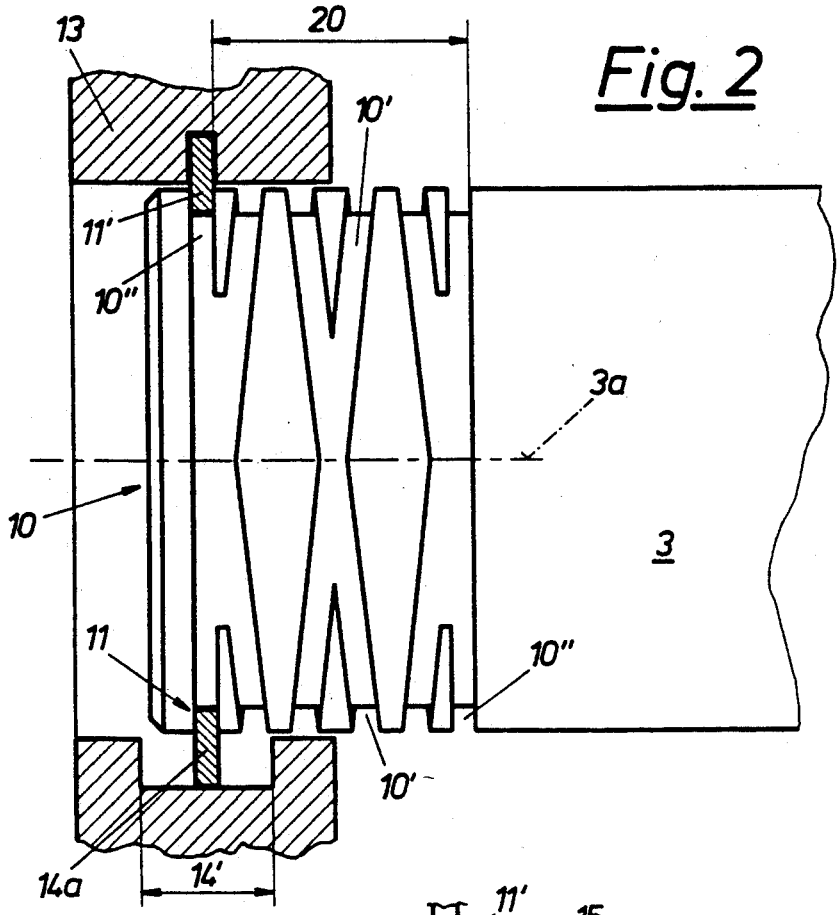
FIG. 2 is a detail of the shifting device along line II—II in FIG. 1.

As is seen in FIG. 2, the shifting profile 10 consists of two guide grooves 10' which are cut into the camshaft 3 in the form of two oppositely oriented helixes. Both guide grooves 10' end in the ring-shaped idling grooves 10" cut into the camshaft. As is seen in FIG. 3a, the engaging element 11 configured as an open spring ring 11' is rigidly connected with the housing 13 or the cylinder head 1 so as to be prevented from rotating, i.e., in an area 14c which is diametrically opposed to the free ends 14a, 14b. The free end 14a of the spring ring 11' is in contact with the plungers 16 of the activating element 12 initiating the shift of the camshaft 3. The movement of the plungers 16 is indicated by arrows 16', while the shifting of the camshaft 3 resulting therefrom is indicated by arrow 3'. To ensure reliable axial shifting of the camshaft 3, the free ends 14a, 14b of the spring ring 11' must have sufficient clearance 14' in the direction of the camshaft axis 3a within the housing 13 or cylinder head 1. Maximum shift length of the camshaft corresponds to the width of the shifting profile 10 and has the reference number 20.

Figure 3:
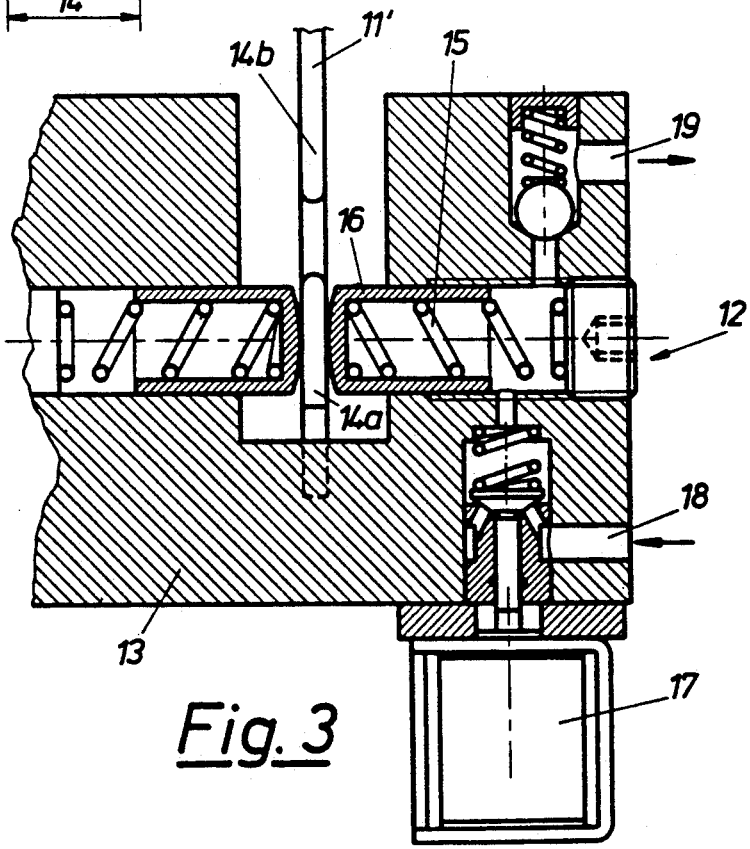
FIG. 3 shows a detail of the shifting device, FIG. 3a an oblique view of a schematically presented activating element, FIG. 3b a variant of the shifting device of the invention, FIG. 3c a section of the shifting device along line III—III in FIG. 3b, FIG. 4 a longitudinal view of the driven end of the camshaft, FIG. 5 a longitudinal view of another variant of the invention, the camshaft being cut away partly, FIG. 6 a section showing a valve mechanism along line IV—IV in FIG. 5, FIG. 7 another longitudinal section of this variant, FIG. 8 a longitudinal section of another variant of the invention.
Figure 3A:
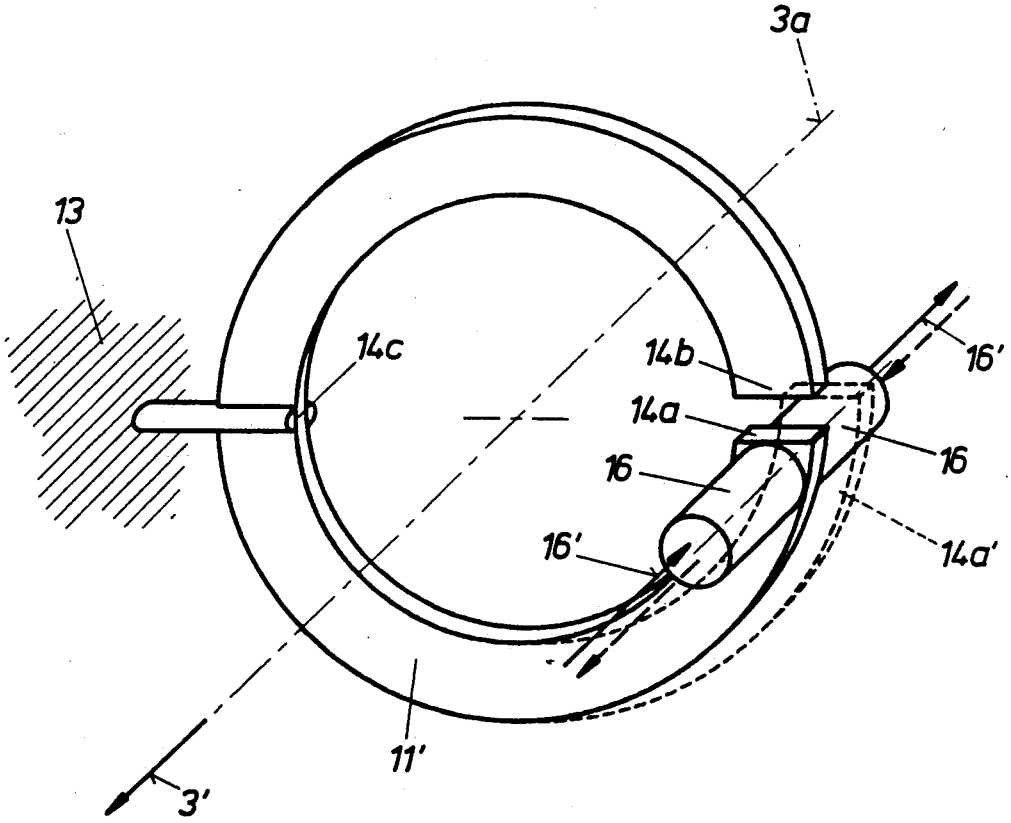

Shifting of the camshaft is initiated by the hydraulically operated activating element 12 presented in FIG. 3. Oil enters through the oil inlet 18 and leaves through the oil outlet 19. In the housing 13 shiftable plungers 16 are held, which are preloaded by springs 15. Apart from the operation initiating movement of the camshaft, the spring ring 11' and the activating element 12 remain in their initial position. At a certain speed the electrically operated valve 17 will open the oil inlet 18 towards one of the two activating plungers 16, such that a bending moment is exerted on the spring ring 11'. As soon as the free end 14a of the spring ring 11' arrives at the beginning of the guide groove 10', the spring ring 11' will automatically slide in the guide groove 10' of the rotating camshaft 3, while the camshaft 3 is shifting along its axis 3a. Switchover between cams 4a and 4b is effected when the respective mushroom tappets face a joint tangential plane 4' formed by the flanks of two adjacent cams 4a, 4b (FIG. 1). As soon as the spring ring 11' arrives at the idling groove 10" the camshaft 3 will stop shifting. For the shifting movement in the opposite direction corresponding parts of identical function are provided, the spring ring 11' being pressed into the opposite direction.

Figure 3B:
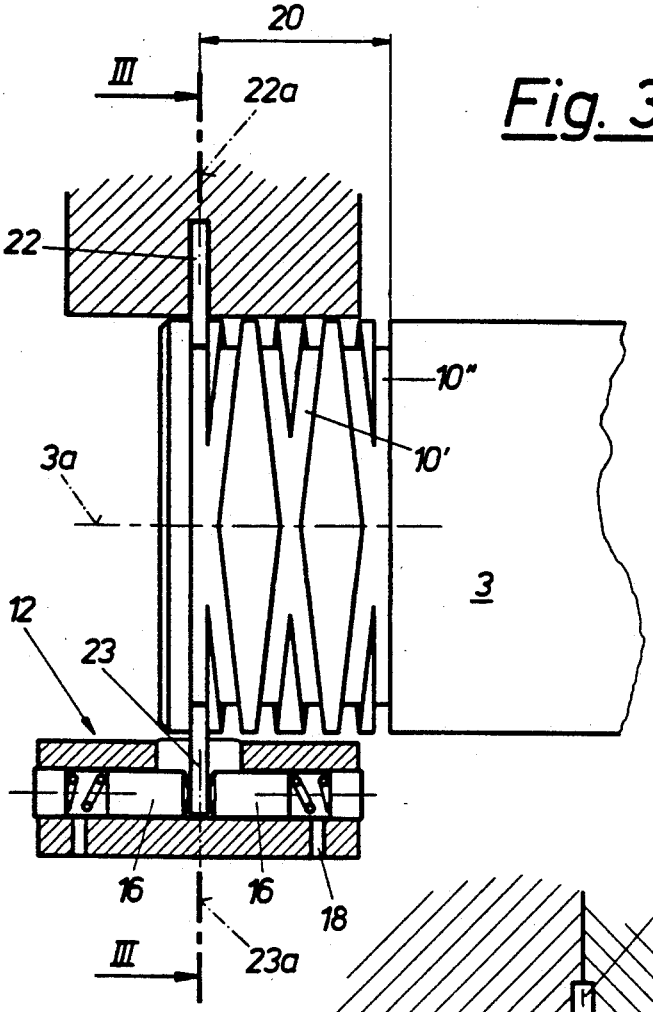
Figure 3C:
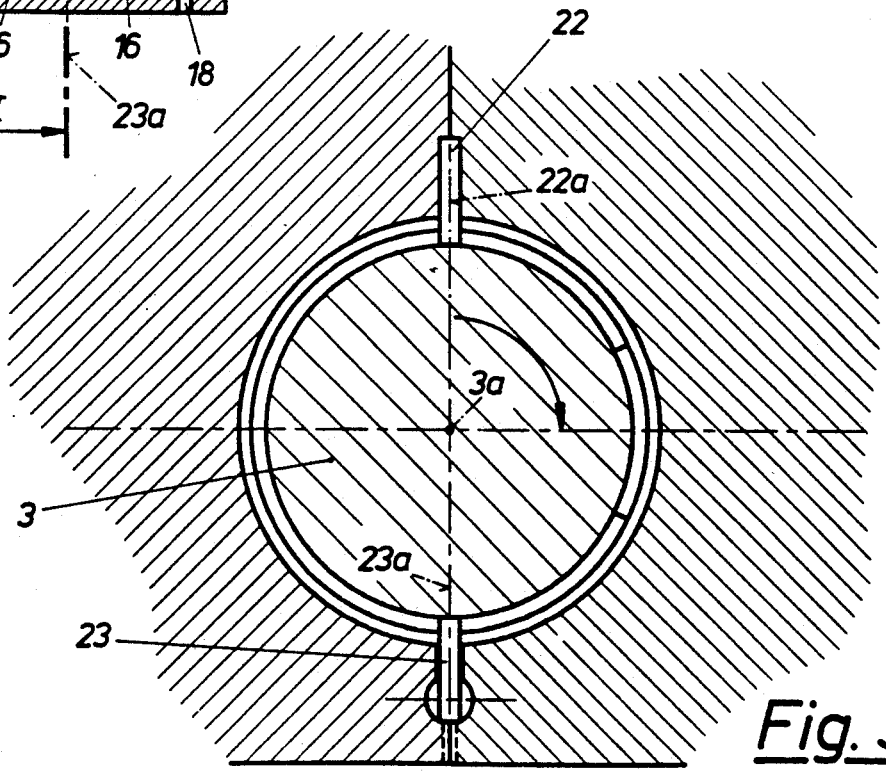

Instead of the spring ring 11' two pins 22, 23 may be used, which are rotatable around their longitudinal axes 22a, 23a, the latter being normal to the camshaft axis 3. In the variant of the invention shown in FIGS. 3b and 3c the two pins 22, 23 are diametrically opposite of each other. Switching is initiated by sliding the pin 23 in the direction of the camshaft axis 3a with the use of one of the two plungers 16 of the activating element 12.

Figure 4:
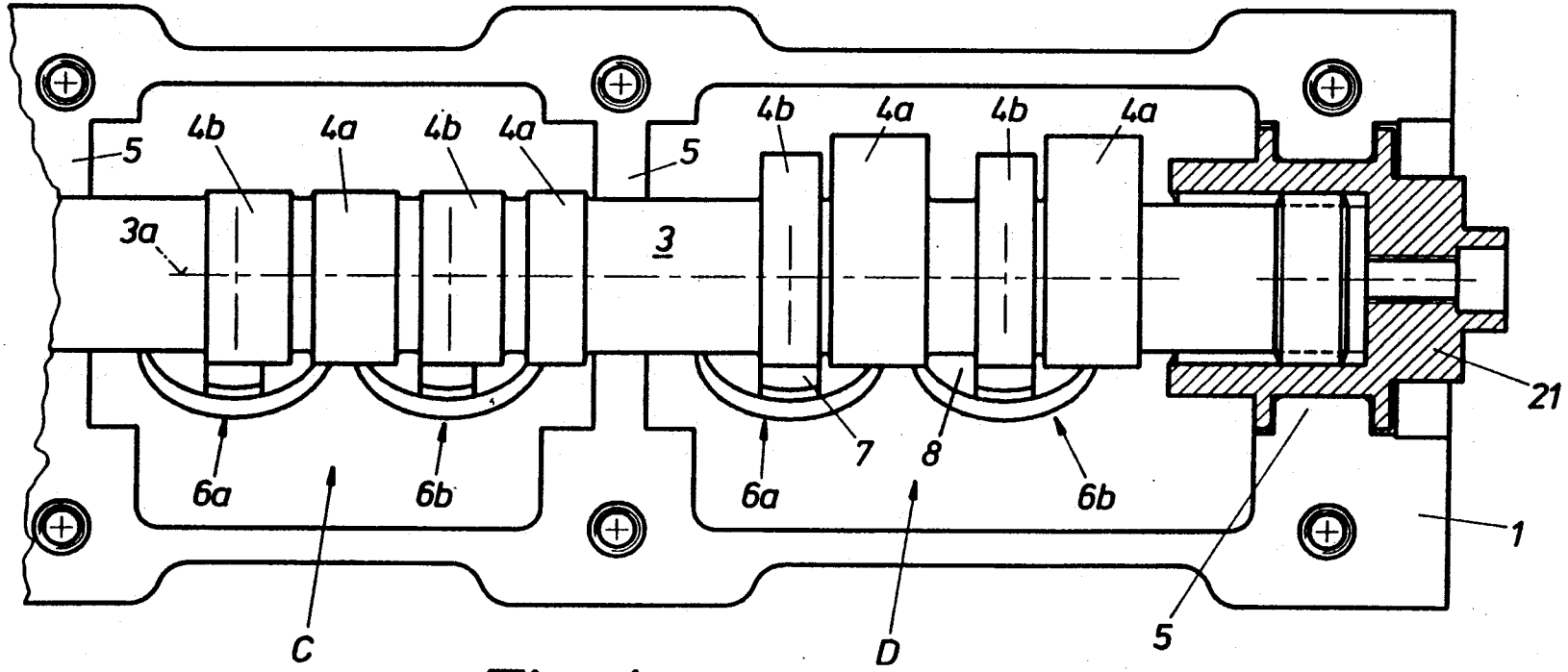

As seen in FIG. 4, the camshaft 3 is driven from the end of the cylinder head 1 opposite of the shifting device 9, via a rotatable slide element 21 supported in the cylinder head 1, by which slide element 21 the camshaft 3 is held so as to permit axial sliding, and to which a gearwheel (not shown) for driving the camshaft can be flange-mounted.

In an embodiment of the above variants the shift length 20 of the camshaft 3 is 18 mm. Due to the shift in phase between the individual cams 4a, 4b it is impossible to switch all cams simultaneously. Shifting of the camshaft proceeds in the following steps: Between 0 and 2 mm lateral play is overcome; in accordance with the timing sequence A-C-D-B, after 2 mm cam 4a of cylinder A is activated, and after 4 mm cam 4a of cylinder C, and after 6 mm cam 4a of cylinder D, and after 8 mm cam 4a of cylinder B. For the remaining shift length of 8 to 18 mm the full width of the cams 4a will act on the bulges 7 of the mushroom tappets 8. During this shifting motion the camshaft 3 performs 2.25 revolutions.

Figure 7:
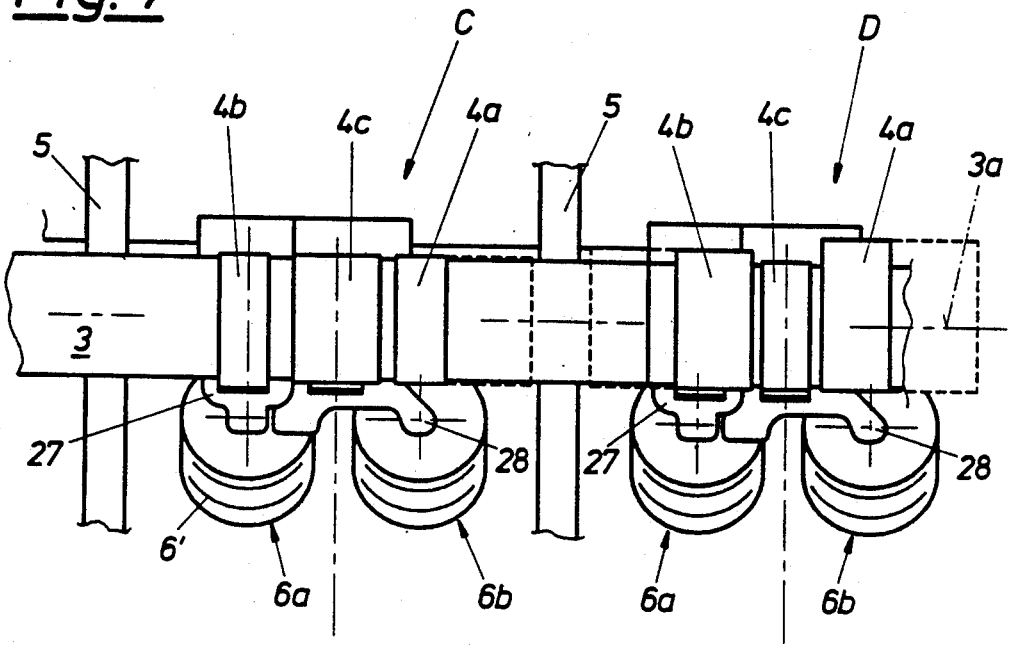

Instead of using separate pairs of cams for each valve the variant shown in FIGS. 5 to 7 provides that three switchable cams 4a, 4b, 4c each be used for control of two valves 6a, 6b of one and the same type per cylinder. The valves 6a, 6b are actuated by means of cam followers 24, 25, each of which is provided with a roller 24', 25' to reduce friction. Via the forked cam follower 25 both valves 6a, 6b may be actuated by a single cam 4a, 4b or 4c, the force of the valve springs 6' being counteracted. In this instance the forked cam follower is in direct contact with the first valve 6a, and in indirect contact with the second valve 6b, i.e. by moving the smaller follower 24.

The use of three different cam types 4a, 4b, 4c will help cover three different operating ranges of the engine, i.e., range B1—full load at high speed: requires synchronous operation of valves 6a, 6b by cam 4a with large lift and long opening time; range B2—full load at low speed, requires synchronous operation of valves 6a, 6b by a cam 4b with small lift and short opening time; range B3 —partial load, requires asynchronous operation of valves 6a, 6b, valve 6a being operated by cam 4b with small lift and short opening time, and valve 6b by cam 4c with very small lift.

In the medium operating position shown in FIGS. 5 and 7 cam 4c, which is designed for a flat valve lift curve with very small lift and short opening time, opens both valves 6a and 6b via the forked cam follower 25. The lift of valve 6a caused by this action is exceeded by the lift transmitted from the cam 6b via the cam follower 24 to the valve 6a, however, so that valve 6a will open much wider than valve 6b. If the camshaft 3 in FIG. 5 or 7 is shifted to the right by the shifting device 9, cam 4b assumes a position above the forked cam follower 25, by means of which it can operate both valves 6a and 6b synchronously, as is suitable for range B2. By shifting the camshaft from its medium operating position in the opposite direction, the cam 4a will be positioned above the forked cam follower 25, so that valves 6a and 6b may be opened synchronously with a large lift, as is suitable for range B1. The broken lines in FIG. 7 indicate extreme positions of the cams.

Figure 8:
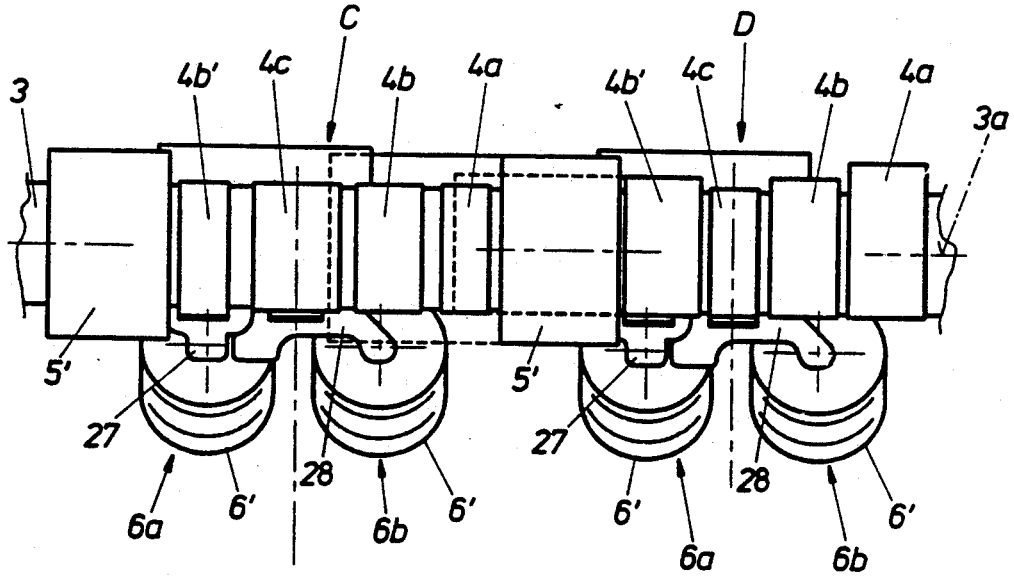

Whereas in the variant of FIGS. 5 to 7 the cams 4b used for engine operating ranges B2 and B3 are the same, i.e., designed for small lifts and short opening times, use of an additional cam 4b', as shown in FIG. 8, will provide better adaptation to these ranges. Compared to the previous variant the positions of cams 4b and 4c are exchanged. The indicated operating position of the camshaft 3 corresponds to operating range B3 of the engine, valves 6a and 6b opening asynchronously. By shifting the camshaft 3 from its indicated position to the left, cam 4b comes to rest above the forked cam follower 28. Synchronous operation of the two valves 6a and 6b by the cam 4b in the operating range B2 of the engine is thus made possible. By further shifting the camshaft 3 to the left cam 4a is positioned above the forked cam follower 28, and cam 4b above the cam follower 27. The movement of cam 4a is superimposed on that of cam 4b, which will result in the synchronous opening of both valves 6a and 6b with a large lift, as is suitable for the operating range B1 of the engine. 5' refers to tunnel bearings for the camshaft, which move together with the shifting camshaft. The maximum movement of the cam 4b' and the tunnel bearing 5' is indicated by a broken line.

The shifting device proposed by the invention may be used for valve control mechanisms both with mushroom tappets and with rocker levers or cam followers.

I claim:

1. An internal combustion engine comprising:

a cylinder head, at least one camshaft having a camshaft axis, said at least one camshaft being rotatable around said camshaft axis within said cylinder head and including several switchable cams for each of several valves, enabling a flow connection between a combustion chamber and one of two flow routes, whereby a first of said flow routes is a suction line and a second of said flow routes is an exhaust gas line, said cams being in different axial positions relative to each other, a shifting device to shift said at least one camshaft axially, said shifting device comprising a shifting profile consisting of at least two guide grooves which are configured as oppositely oriented helixes and which end in ring-shaped idling grooves, each of said idling grooves defining different operating positions of said camshaft, an engaging element running in one of said idling grooves and being introducible into said guide grooves, and an activating element to introduce said engaging element into one of said guide grooves.

2. Internal combustion engine according to claim 1, wherein said two guide grooves are cut into said camshaft, and said engaging element is secured against rotation about said camshaft axis and is connected with said cylinder head.

3. Internal combustion guide according to claim 2, wherein said engaging element is configured as an open spring ring placed concentrically around said camshaft and is attached to said cylinder head at a point diametrically opposite of two free ends of said spring ring so as to be secured against axial shifting, whereby one of said two free ends may be bent by the activating element parallel to said camshaft axis.

4. Internal combustion engine according to claim 2, wherein said engaging element is formed by a first cylindrical pin and a second cylindrical pin whose geometrical longitudinal axes are approximately normal to said camshaft axis, both pins being held in said cylinder head, said second pin also being capable of sliding parallel to said camshaft axis and said sliding motion being effected by said activating element.

5. Internal combustion engine according to claim 4, wherein said first cylindrical pin and said second cylindrical pin are pivoted so as to be rotatable around their longitudinal axis.

6. Internal combustion engine according to claim 1, wherein said activating element is operated hydraulically.

7. Internal combustion engine according to claim 1, wherein at least a first of said cams is activated in a first of said operating positions of said camshaft and has a smaller lobe than the second cams of said cams which are activated in another operating position of said camshaft.

8. Internal combustion engine according to claim 7, wherein several first valves of said valves enable said flow connection between said combustion chamber and one of said flow routes, wherein at least one first cam of said cams which is used with one of said first valves in at least a first of said operating positions of said camshaft has a smaller lobe than another first cam which is used with another valve of said first valves which is activated in said at least first of said operating positions.

9. Internal combustion engine according to claim 1, wherein several first valves of said valves enable said flow connection between said combustion chamber and one of said flow routes, wherein at least one first cam of said cams which is used with one of said first valves in at least a first of said operating positions of said camshaft has a smaller lobe than another first cams which is used with another valve of said first valves which is activated in said at least first of said operating positions.

10. Internal combustion engine according to claim 1, wherein several first valves of said valves enable said flow connection between said combustion chamber and one of said flow routes, wherein at least one first cam of said cams which is used with one of said first valves in at least a first of said operating positions of said camshaft has a smaller lobe than another first cam which is used with another valve of said first valves which is activated in said at least first of said operating positions, whereby in at least the first of said operating positions of said camshaft said first cams are activated to operate several of said first valves by means of a forked rocker lever.

* * * * *

UNITED STATES PATENT AND TRADEMARK OFFICE

CERTIFICATE OF CORRECTION

PATENT NO. : 5,289,806

DATED : March 1, 1994

INVENTOR(S) : Wiliam J. HURR

It is certified that error appears in the above-identified patent and that said Letters Patent is hereby corrected as shown below:

In the heading:

[30] Foreign Application Priority Data

Jul. 13, 1992 [AT] Austria ..... 1437/92

Signed and Sealed this

Twenty-first Day of June, 1994

Bruce Lehman

*Attest:*

BRUCE LEHMAN

*Attesting Officer*

*Commissioner of Patents and Trademarks*